US009413053B2

(12) United States Patent
Blodt

(10) Patent No.: US 9,413,053 B2
(45) Date of Patent: Aug. 9, 2016

(54) GALVANICALLY ISOLATED, DIRECTIONAL COUPLER

(75) Inventor: Thomas Blodt, Basel (CH)

(73) Assignee: ENDRESS + HAUSER GMBH + CO. KG, Maulburg (DE)

( * ) Notice: Subject to any disclaimer, the term of this patent is extended or adjusted under 35 U.S.C. 154(b) by 0 days.

(21) Appl. No.: 14/236,645

(22) PCT Filed: Jul. 16, 2012

(86) PCT No.: PCT/EP2012/063874

§ 371 (c)(1),
(2), (4) Date: Feb. 3, 2014

(87) PCT Pub. No.: WO2013/017397

PCT Pub. Date: Feb. 7, 2013

(65) Prior Publication Data

US 2014/0285283 A1 Sep. 25, 2014

(30) Foreign Application Priority Data

Aug. 4, 2011 (DE) ..... 10 2011 080 429

(51) Int. Cl.
*H01P 5/18* (2006.01)

(52) U.S. Cl.
CPC ..... *H01P 5/184* (2013.01); *H01P 5/185* (2013.01); *H01P 5/186* (2013.01)

(58) Field of Classification Search
CPC ..... H01P 5/04; H01P 5/14; H01P 5/16; H01P 5/20; H01P 5/181; H01P 5/182; H01P 5/183; H01P 5/184
USPC ..... 333/109, 116
See application file for complete search history.

(56) References Cited

U.S. PATENT DOCUMENTS 3,904,991 A * 9/1975 Ishii ..... H01P 5/185 333/116
4,777,458 A 10/1988 Pardini
5,557,245 A 9/1996 Taketa
(Continued)

FOREIGN PATENT DOCUMENTS

DE 2839874 4/1979
DE 69419088 T2 12/1999
(Continued)

OTHER PUBLICATIONS

German Search Report, German PTO, Munich, Jan. 30, 2012.
International Search Report, EPO, The Netherlands, Oct. 11, 2012.
English translation of IPR, WIPO, Geneva, Feb. 13, 2014.

*Primary Examiner* — John Poos
(74) *Attorney, Agent, or Firm* — Bacon & Thomas, PLLC

(57) ABSTRACT

A galvanically isolated, directional coupler, especially for in- and out-coupling of high-frequency measurement signals of a radar fill-level measuring device, wherein two mutually engaging, oppositely bent, conductive traces are provided, wherein the two oppositely bent, conductive traces are so arranged that that they couple with one another over a region of a quarter wavelength (λ/4) of the wavelength associated with the center frequency of the measuring signals and form two groups of laterally coupled, conductive traces, and wherein curved conductive trace portions adjoin each of the two groups of laterally coupled, conductive traces, in each case, over a region, which is less than an eighth wavelength (λ/8) of the wavelength associated with the center frequency.

11 Claims, 8 Drawing Sheets

(56) References Cited

U.S. PATENT DOCUMENTS

| | | | | |
|---|---|---|---|---|
| 5,629,654 | A | 5/1997 | Frick | |
| 7,778,040 | B2 | 8/2010 | Ahn | |
| 2002/0149441 | A1 | 10/2002 | Catoiu | |
| 2005/0122185 | A1 | 6/2005 | Podell | |
| 2007/0296517 | A1* | 12/2007 | Schmidt | 333/116 |
| 2010/0001810 | A1* | 1/2010 | Charley et al. | 333/109 |

FOREIGN PATENT DOCUMENTS

| | | | |
|---|---|---|---|
| DE | 102007002202 | A1 | 8/2007 |
| DE | 102006015338 | A1 | 10/2007 |
| EP | 2002505 | B1 | 12/2008 |

* cited by examiner

GALVANICALLY ISOLATED, DIRECTIONAL COUPLER

TECHNICAL FIELD

The invention relates to a galvanically isolated, directional coupler, especially for in- and out-coupling of high-frequency measurement signals of a radar fill-level measuring device. Furthermore, the invention relates to a transmitting/receiving separator for a radar fill-level measuring device, in which the directional coupler of the invention is applied.

BACKGROUND DISCUSSION

Directional couplers are circuits of high frequency technology, which have the property that they divide a signal of predetermined frequency, which is fed into an input port, in a defined manner on two output ports. The dividing of the signal components onto the two output ports must, in such case, not occur equally. In the case of a directional coupler with four ports, one port is "decoupled", i.e., in the ideal case, no signal components are output on this port. In the case of an individually considered port, the dividing onto the remaining ports depends on the direction of the signal, respectively the waves, through the considered port. One speaks, consequently, of a directional coupler.

There are many different forms of directional couplers in diverse technologies. A basic type in microstrip conductor technology is a coupler formed of coupled lines. This is based, among other things, on the physical property that two wave signals with a phase difference of 180° cancel destructively. With reference to high frequency waves, this means a canceling at a phase difference of a half wavelength ($\lambda/2$) at the considered frequency.

The functional principle of a directional coupler of coupled lines can be described in simplified manner as follows. The coupler of coupled lines is composed of two lines lying next to one another along a distance of a quarter wavelength ($\lambda/4$) of the considered frequency. A corresponding directional coupler is shown in FIG. 1 and is described in greater detail in the description of the figures.

Interferences occur in regions, in which the lines lie near enough to one another. In the case of a simple coupling of two lines of a quarter wavelength, a part of the power fed into a port is transmitted from one line to the other. The transmission of the power occurs, for example, in the region of a quarter wavelength. The rest of the power goes to the remaining port. Further explanations of this follow in the description of the figures.

SUMMARY OF THE INVENTION

An object of the invention is to provide a directional coupler and a transmitting/receiving separator, which are distinguished by increased bandwidth and simple construction.

The object is achieved by features including that two mutually engaging, oppositely bent, conductive traces are provided, wherein the two oppositely bent, conductive traces are so arranged that they couple with one another over a region of a quarter wavelength ($\lambda/4$) of the wavelength associated with the center frequency of the measuring signals and form two groups of laterally coupled, conductive traces, and that curved conductive trace portions adjoin each of the two groups of laterally coupled, conductive traces, in each case, over a region, which is less than an eighth wavelength ($\lambda/8$) of the wavelength associated with the center frequency.

In the case of two conductive traces, the essentially "round", directional coupler has four ports. Preferably, the directional coupler is constructed rotationally symmetrically, whereby none of the ports of the directional coupler is preferred. The meaning of term "port" will be clear from the above description of the state of the art.

It has been found that, starting from an eighth wavelength, the properties of the coupler of the invention improve with declining length down to about 1/16 wavelength of the center frequency. A more extensive shortening of the length begins then to offer only slight improvement.

An advantageous embodiment of the directional coupler of the invention provides that the directional coupler is constructed of at least one SMD component. The SMD component is either a resistor or a capacitor or two equally constructed resistors or capacitors.

The at least one component (capacitor or equally constructed resistors) is arranged in a horizontal plane of a circuit board, or it is provided in at least two parallel planes of a circuit board.

An advantageous embodiment of the directional coupler of the invention provides that the two transitions between the laterally coupled, conductive traces and the bent conductive traces are so embodied that the high-frequency measuring signals are transmitted with an as great as possible bandwidth. Preferably, the conductive traces have a toothed structure.

Furthermore, it is provided that the directional coupler is so dimensioned that it acts as a 3 dB coupler. The terminology, 3 dB coupler, means that the coupler is so dimensioned that a uniform power division occurs on two ports.

The transmitting/receiving separator of the invention for a radar, fill level, measuring device is composed of an above described, directional coupler and a terminating element, respectively a high frequency sink, respectively a matched termination, which is provided on one of the at least four ports of the directional coupler.

An embodiment of the transmitting/receiving separator of the invention provides that the terminating element, respectively the high frequency sink, is composed of a resistor, which has double the resistance of the line wave resistance, respectively impedance, and a match structure.

Moreover, it is provided that the match structure is composed of three mutually connected, conductive trace portions of defined length and width and two vias to the reference potential ply of the circuit card.

Furthermore, it is provided in connection with the transmitting/receiving separator of the invention that the three remaining ports of the directional coupler are connected to an antenna, a transmitting unit and a receiving unit of the radar fill-level measuring device.

BRIEF DESCRIPTION OF THE DRAWINGS

The invention will now be explained in greater detail based on the appended drawing, the figures of which show as follows.

DETAILED DISCUSSION IN CONJUNCTION WITH THE DRAWINGS

Figure 1:
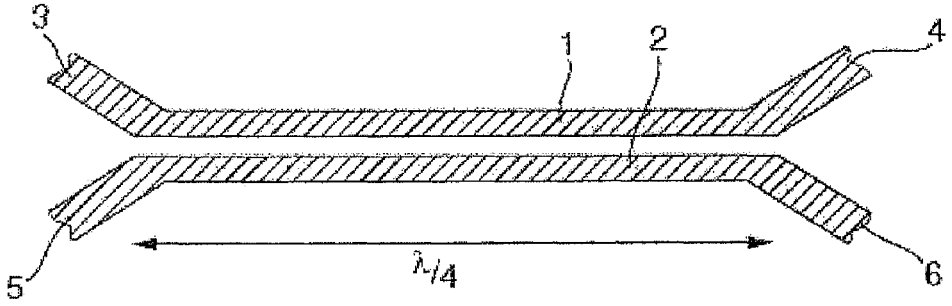
Fig. 1 (Prior Art)
FIG. 1 is a plan view onto a known directional coupler with two coupled lines.

FIG. 1 shows a plan view onto a known linear directional coupler having two coupled lines 1, 2 and four ports 3, 4, 5, 6. The two coupled lines 1, 2 extend parallel to one another along a distance of a quarter wavelength $\lambda/4$ of the considered frequency.

Interferences occur in the regions, in which the lines 1, 2 lie near enough to one another. In the case of a simple coupling of two lines 1, 2 of a quarter wavelength $\lambda/4$, a part of the power fed into a port 3 is transmitted from a line 1 to the other line 2. The transfer of the power occurs in the region of a quarter wavelength $\lambda/4$. A part of the power arrives at port 4, while the rest of the power reaches the remaining port 6.

Figure 2:
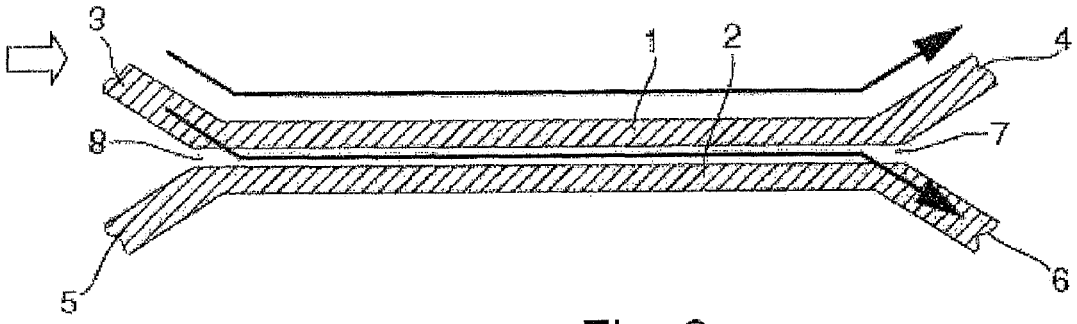
Fig. 2 (Prior Art)
FIG. 2 is a representation of how a signal in the directional coupler shown in FIG. 1 is divided into individual signal components.
Figure 3:
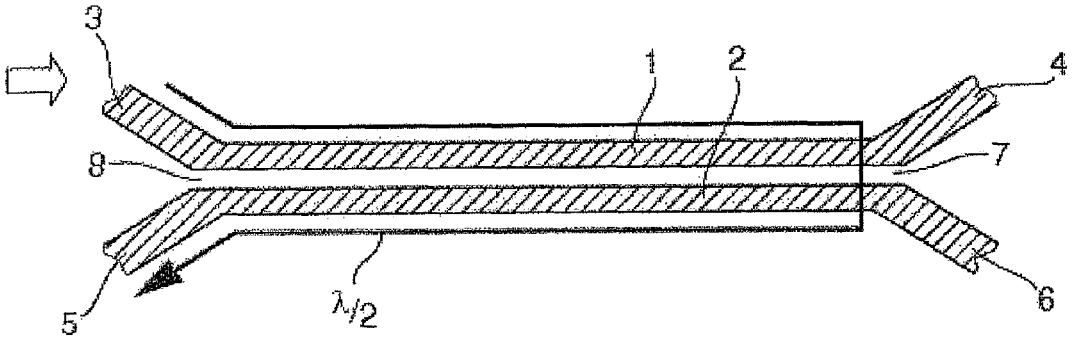
Fig. 3 (Prior Art)
FIG. 3 is a representation of the decoupling of a port in the case of the directional coupler illustrated in FIG. 1.

FIG. 2 shows a representation of the dividing of a signal in the case of the directional coupler shown in FIG. 1. FIG. 3 shows a representation of the decoupling of the port 5 in the case of the directional coupler illustrated in FIG. 1. Especially, FIG. 2 shows how the signal of port 3 is divided between the ports 4, 6, wherein the greater signal portion is available at port 4.

In the region of the sharp bends 7, 8 on both sides of the coupled lines 1, 2, in each case, a small part of the signal is reflected. Thus, there arises between the ports 3, 5 a direct, though weak, coupling in the region of the sharp bends 7, 8. Via the signal path from the sharp bend 8 via the sharp bend 7 back to the sharp bend 8 there results a signal path of a half wavelength $\lambda/2$ in the region, in which the two lines 1, 2 lie near to one another. As a result of destructive interference, a canceling of the signal occurs, whereby port 5 is decoupled.

Due to the symmetric embodiment of the directional coupler, the earlier described behavior shows up likewise when the signal is introduced not into port 3, but, instead, into one of the other ports 4, 5, 6. Then, the decoupled port and the port with the largest of the other two power portions change correspondingly.

Of course, for optimized dimensioning, also multiple reflections and different propagation velocities of the signals can, respectively must, be taken into consideration.

In the following, the properties of a coupler with coupled lines 1, 2 will now be described. The conditions for coupling and for destructive interference hold, in each case, for the considered frequency. For frequencies outside of the center frequency, these conditions are only uncleanly fulfilled, so that the coupler characteristics worsen strongly with increasingly deviating frequency. Thus, this is a narrow band coupler.

For direct voltage and signal components of very low frequency, there is no coupling in the region where the lines 1, 2 lie near to one another. The ports 3, 4 are galvanically isolated from the ports 5, 6. No galvanic isolation is present between the ports 3, 4 and 5, 6, respectively.

A disadvantage of the linear coupler is that the decoupling of the respectively decoupled port (port 5 in FIG. 3) is in the case of this coupler type relatively poor.

Figure 4:
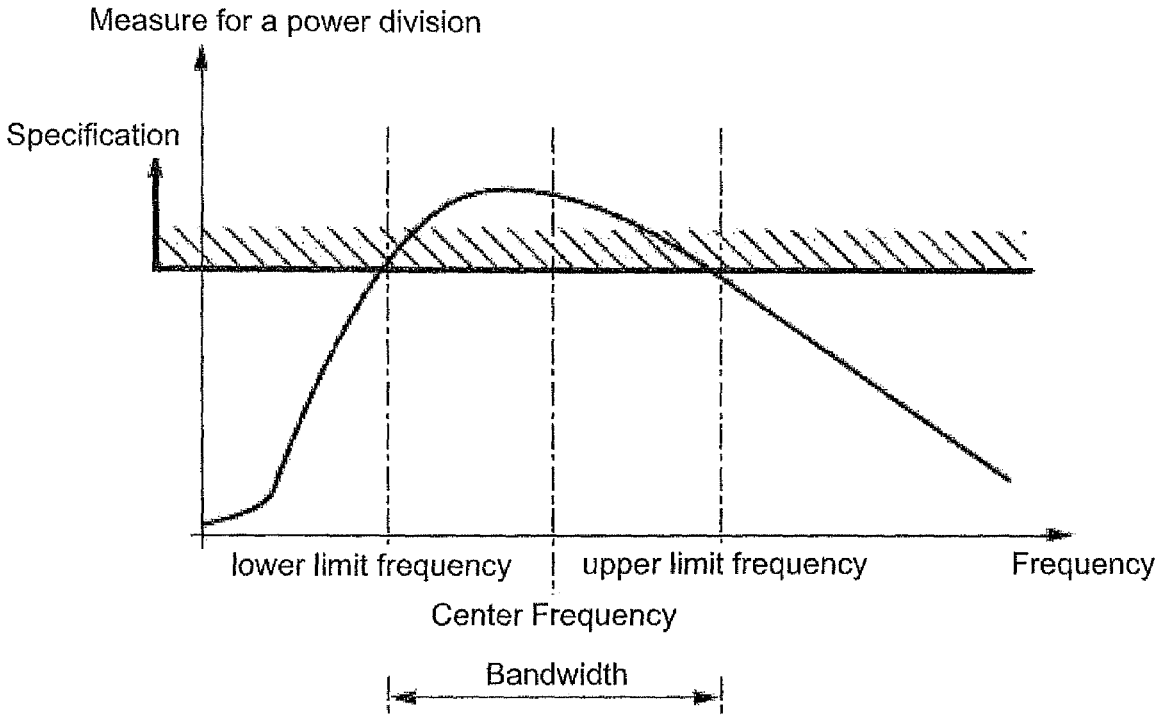
FIG. 4 is a representation for ascertaining bandwidth of a directional coupler.

FIG. 4 shows a schematic representation of ascertaining the bandwidth of a directional coupler. These considerations hold both for the known directional coupler as well as also for the directional coupler of the invention.

In the case of a coupler, certain criteria, such as the measure for the decoupling and or the ratio of the power distributions to the individual ports can be specified. As already mentioned above, the properties of a directional coupler worsen, the more strongly the frequency deviates from the center frequency. Theoretically, a frequency range can be determined, in which acceptable sizes for the individual criteria are still just fulfilled. This frequency range is referred to as the bandwidth of a directional coupler and designates, thus, a certain frequency range. The cutoffs of the bandwidth are the upper limit frequency and lower limit frequency.

The broadbandedness of a directional coupler is defined as the ratio the above defined bandwidth to the center frequency and is usually given in percent. The center frequency of a component or of a frequency-statically behaving assembly corresponds to the linear mean (frequencies can also be presented logarithmically) between the upper and the lower limit frequencies. The broadbandedness can, thus, lie in a range between >0% and <200%.

Figure 5:
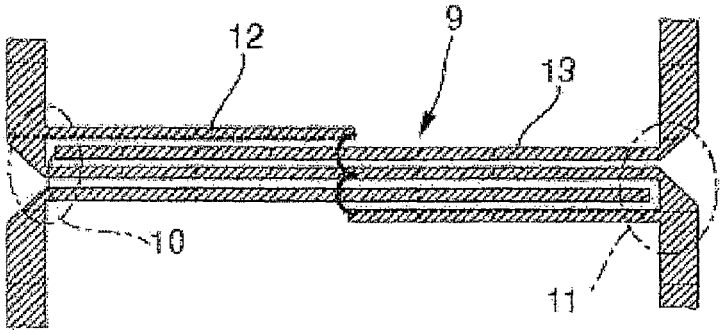
Fig. 5 (Prior Art)
FIG. 5 is a plan view onto a known Lange coupler.

FIG. 5 is a plan view onto a simple embodiment of a Lange coupler 9. The Lange coupler 9 represents an improvement compared with the simple, linear, directional coupler illustrated in FIGS. 1-3. The Lange coupler 9 is, moreover, also referred to as an interdigital coupler. For improving the coupling characteristics, a number of coupling structures 12, 13 of a quarter wavelength are connected in parallel. Furthermore, the coupling of most of the line elements—with the exception of the outer line elements—occurs on both sides, i.e. a line element is located, in each case, near to two additional line elements. In this way, a desired power distribution can be achieved. Furthermore, the regions 10, 11 are further developed in comparison to the regions 7, 8 in FIGS. 1-3.

With the Lange coupler 9, good coupling is still possible in the range of wavelengths, which deviate slightly from the center frequency. Additionally, in the case of the Lange coupler 9, the multiple reflections can be best made use of.

Figure 6:
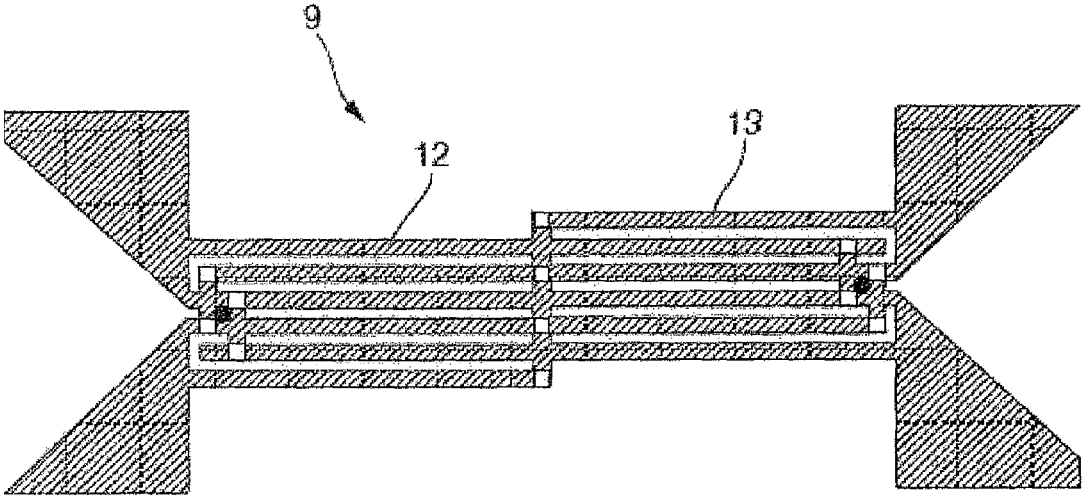
Fig. 6 (Prior Art)
FIG. 6 is a plan view onto a known Lange coupler having six fingers.

For additionally improving the bandwidth, the decoupling and/or the power distribution (dimensionally dependently and partially in opposition to one another), the number of coupling structures 12, 13, which, in each case, have a length of, for instance, a quarter wavelength of the center frequency, can be multiply expanded. This embodiment is shown in FIG. 6, by way of example.

A four fingered Lange coupler 9 as in FIG. 5 permits achieving a broadbandedness of, for example, 80%. Increasing the number of coupling structures 12, 13 does, indeed, improve the broadbandedness, but leads, however, also to increasingly narrower line portions, narrower line separations and—as regards manufacture—to an increase in the number of connecting, or bond, wires. Moreover, more finely structured circuit board structures are more complex and more expensive to manufacture, provided that such is technically feasible at all. For processing bond wires, additionally, particularly expensive machines are necessary. The bond wires needed for high frequency structures are very fine and very sensitive as regards handling and transport and can, moreover, be repaired manually only by the expenditure of much time.

Figure 7:
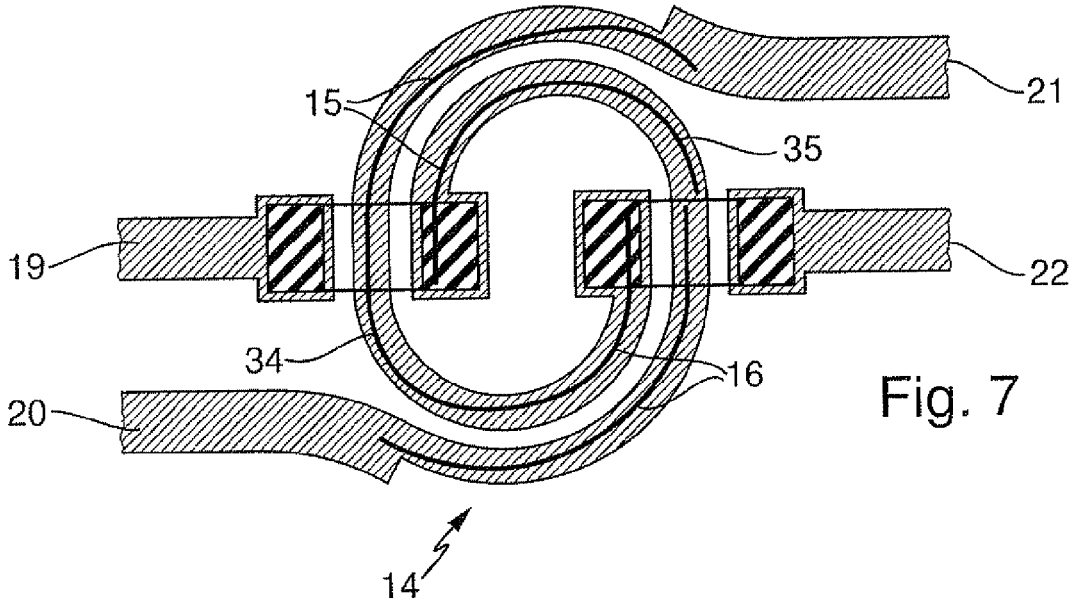
FIG. 7 is a representation of the segment portions of a preferred embodiment of the directional coupler of the invention.

FIG. 7 shows a representation of a preferred embodiment of the directional coupler 14 of the invention. Especially to be seen here are the individual segment portions 15, 16, 34, 35 of the directional coupler of the invention. The directional coupler of the invention 14 has a "round" shape, is galvanically isolated and serves preferably for in- and out-coupling of high-frequency measurement signals of a radar fill-level measuring device. Also a mixer can be implemented in similar manner.

According to the invention, two mutually engaging, oppositely bent, conductive traces are provided, wherein the two oppositely bent, conductive traces are so arranged that

- they couple with one another over a region (23, 24 to 25, 26, respectively 27, 28 to 29, 30) of a quarter wavelength $\lambda/4$ of the wavelength associated with the center frequency of the measuring signals and form two groups of laterally coupled, conductive traces 15, 16, and
- curved conductive trace portions 34, 35 adjoin each of the two groups of laterally coupled, conductive traces 15, 16, in each case, over a region, which is less than an eighth wavelength $\lambda/8$ of the wavelength associated with the center frequency.

The round directional coupler 14 of the invention virtually combines the interference characteristics of adjoining and mutually following line portions of the length of a quarter wavelength with the interference characteristics of a wave traveling around a circle, such as is used, for example, already in hybrid couplers or branch line couplers. However, the known hybrid couplers have no laterally coupled structures.

Figure 10:
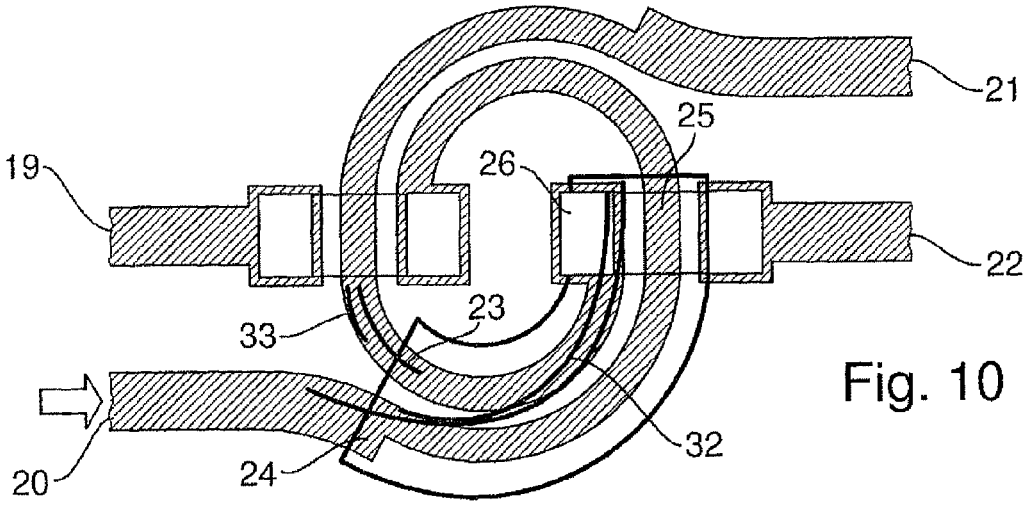
FIG. 10 is a clarification of the operation of the directional coupler illustrated in FIG. 7 as regards achievable broadbandedness.

The invention, thus, combines laterally coupled structures and the interferences occurring as a result of a "closed" ring. The terminology, closed ring, refers, in such case, to the high frequency signal path. According to the invention, two groups of laterally coupled line pairs 15, 16 of the length of a quarter wavelength of the center frequency are coupled with one another by two other bent line portions 34, 35 of length clearly smaller than an eighth wavelength of the center frequency. Instead of the sharp bends in the separation of the lines occurring in the case of the state of the art, the solution of the invention has soft, flowing transitions (see transition 36 in FIG. 11). In this way, point 23 shifts as boundary between the coupling structure 32 and the connecting line 33 (see FIG. 10). At the center frequency, the corresponding length lies, for example, at about 1/30 wavelength and changes within the bandwidth in the range of about 1/64 (lower frequencies) to about 1/16 (higher frequencies) non-linearly with the frequency. A dimensioning in the range, for example, 1/10 to 1/40 is, however, likewise possible.

Figure 8:
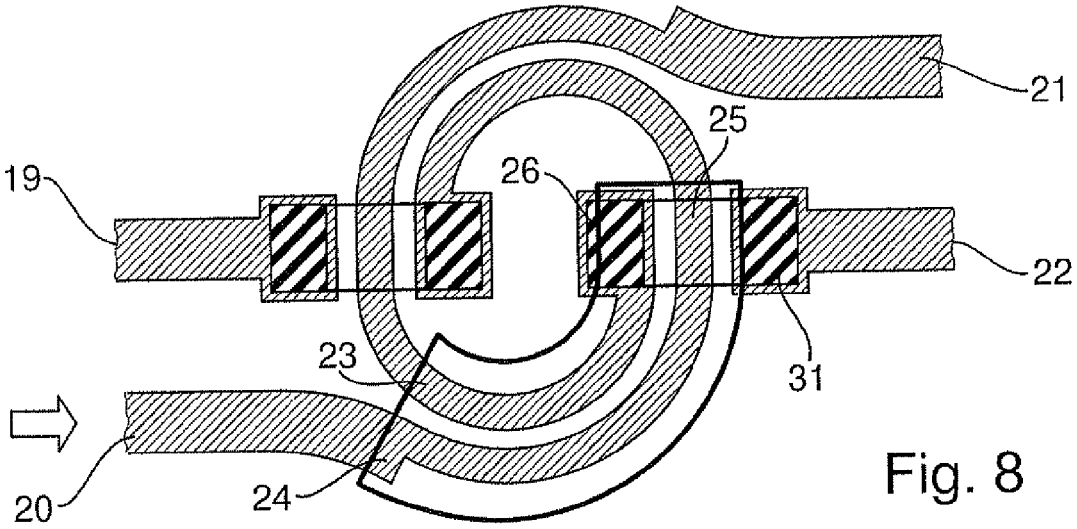
FIG. 8 is a clarification of the operation of the directional coupler illustrated in FIG. 7.

Operation of the directional coupler 14 of FIG. 7 will now be explained in greater detail based on FIGS. 8 and 9. It is assumed here that the signal is fed into port 20. There is between the region 24, 23 and 25, 26 an effect similar to that produced in the coupler of coupled lines shown in FIG. 1. The wave incoming at point 24 (incoming signal) is divided at the points 25, 26, while no power fractions reach point 23. First, a part of the output power arrives at port 22, and another part of the wave travels on at point 25.

Figure 9:
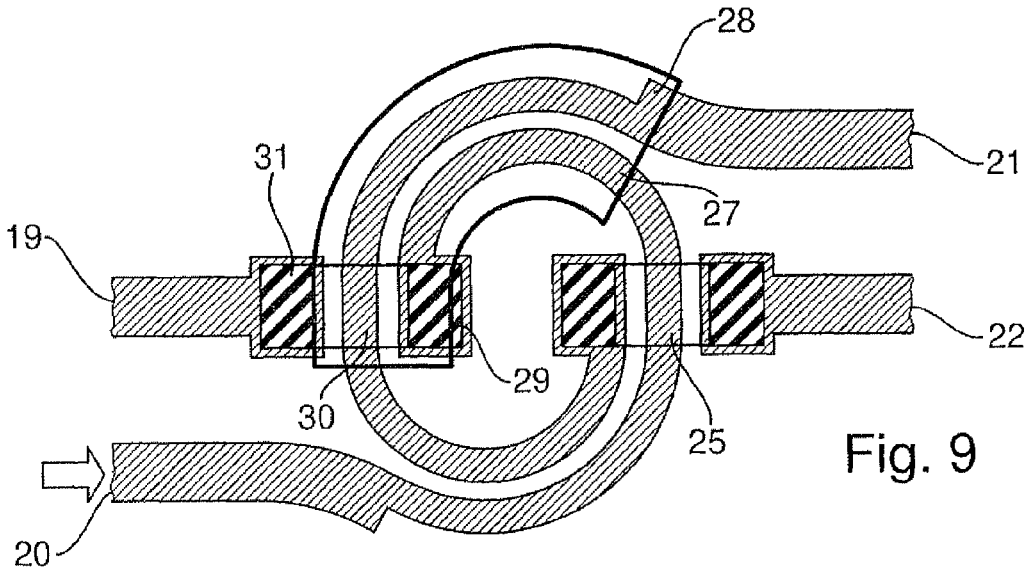
FIG. 9 is another clarification of the operation of the directional coupler illustrated in FIG. 7.

This wave outgoing via point 25 in a very short travel time reaches point 27 (see FIG. 9). At point 27 there begins a structure, which, again, is similar to the structure of the known coupler of coupled lines shown in FIG. 1. This structure extends in the region from the points 28, 27 to the points 29, 30.

As in the case of a known coupler of two coupled lines, first of all, no power fractions reach the point 28 adjoining port 21. The power of the wave is divided between the points 29 and 30. The power fractions at point 29 are partially reflected and partially led via the SMD component 31 to the port 19.

The reflected power fractions are, in turn, according to the principle of coupled lines, divided between the points 27 and 28. The power fractions at point 28 go to the port 21. The power fractions at point 27 travel to point 25. The signal path behaves in the same way. The power fractions at point 30, however, travel to the point 23. In comparison to the next period of the wave reaching point 24 via port 20, there is a phase difference of 180°. Since the waves are, however, conveyed on different lines, the region 24, 23 produces a destructive interference. Since, such as above described, a part of the wave of point 24 reaches point 26, there occurs in the total region from 23 to 26 a destructive interference. Port 22 is accordingly very well decoupled. Through a suitable dimensioning, moreover, a uniform power distribution to the ports 19 and 21 can be achieved for a large broadbandedness.

Frequencies deviating from the center frequency lead to differing wavelengths. Drawn in FIG. 10, by way of example, are a longer wavelength (longer line in 32; lower frequency) and a shorter wavelength (shorter line in 32; higher frequency). Due to the "soft" transition in the region around the points 23, 24 relative to the separation of the coupled lines, the operation of this coupler is possible both for the somewhat lower as well as also for the somewhat higher frequency; the two wavelengths are still "suitable" in this structure of marked broadbandedness.

In the case of the coupler of coupled lines shown in FIG. 1, there is a "sharp bend" at both ends. There is thus a sharp bounding of the laterally coupled structures (see also FIG. 11). As a consequence of this abrupt transition, the coupler is narrow banded.

Due to the frequency dependence of the length of the laterally coupled structures 32, different lengths of the bent connecting lines 33 result. The lengths are, however, clearly shorter than an eighth of the associated wavelengths, so that this influence is small.

More exactly considered, the two line lengths 34 and 35 lead, moreover, to a compensation of the continually arising travel time difference of the in, and out, of phase modes arising in a laterally coupled structure. This is mentioned here for reasons of completeness. It contributes nothing, however, to a basic understanding of the operation of the coupler of the invention. Due to the different field spreading of the different wave modes, a different, mode dependent, effective coupling length of the bent line portions results, which differs from the different, mode dependent, effective coupling length of straight, coupled line portions.

Likewise, the different modes must be taken into consideration in the case of the destructive interference in the region from point 23 to point 26, and, indeed, especially in the case of frequencies, which deviate from the center frequency. Various modes occur, moreover, also in the case of the coupler of coupled lines and other types of couplers.

Figure 11:
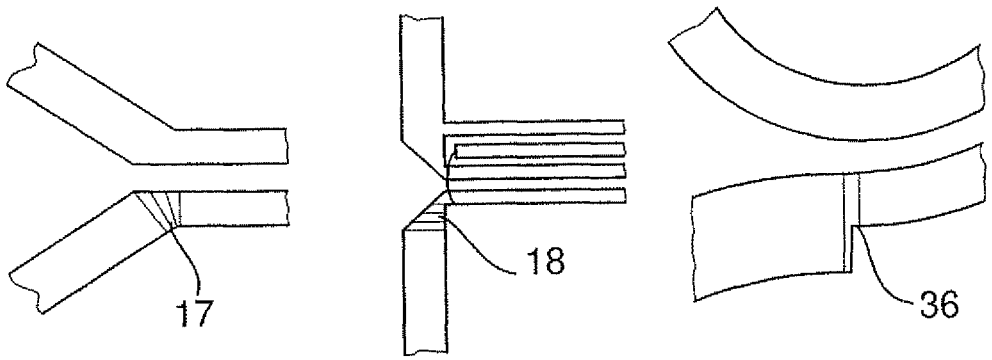
FIG. 11 is a representation of the transitions of line impedance.

In connection with FIG. 11, an abrupt transition of the line impedance will now be described. A medium, in which a physical wave propagates, has a wave impedance. This is also called wave resistance or—with reference to connecting lines for signals of high frequency fractions such as in the case of the here applied, microstrip lines—line wave resistance, respectively impedance. Basically, this describes the stiffness, which the medium presents to the wave (compare physical flow resistance). A microstrip line is composed of a connecting line on board material with traversing copper backing layer without interruptions in the surrounding region. The line impedance of a microstrip line depends on the width of the line on the upper side of the board.

There are a number of options for connecting two lines of different line impedances, for example, a hardened transition, a conically extending line segment or other partially complex structures.

The known coupler of coupled lines as well as the Lange coupler use a flowing transition 17, 18, while, in the case of the new, round coupler 36, an abrupt, so-called "impedance jump" is necessary. More exactly considered, a certain field distribution results at this impedance jump. The influence of impedance jumps in general is state of the art. Especially, the different modes of laterally coupled, conductive traces have an influence, so that here such impedance jumps are necessary.

In the case of the coupler types based on circulating waves, such as hybrid ring couplers and branch line couplers, likewise a hard impedance jump is necessary. A coupler already exists, based only on a laterally coupled structure, in the case of which a soft transition is necessary. This is called the "Tapered Coupled Line Hybrid Coupler in the 180° Embodiment".

The operation of the coupler 14 of the invention with coupling elements and circulating wave is based on effects of coupling via a metallically non-connected separation (the "lateral coupling" such as in the case of the coupler of coupled lines or the Lange coupler) and a wave traveling a closed loop, such as, for example, in the case of the coupler types: Hybrid ring coupler, branch line coupler and rat race coupler.

Alternatively to lateral coupling, also other distributed coupling structures are possible for the coupler 14 of the invention, for example, lines superimposed as different conductive traces, provision of lines with teeth, application of multiple, fine, connecting lines and material of defined resistivity in the region between the lines.

Figure 12:
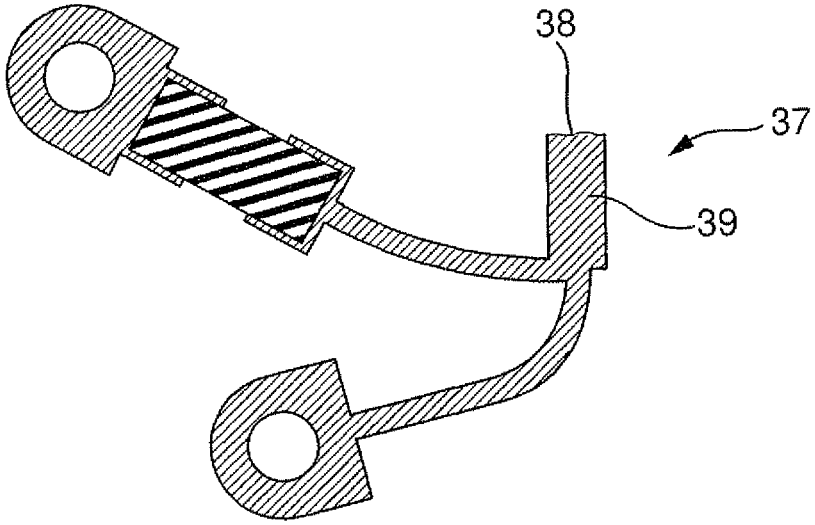
FIG. 12 is a representation of a matched terminating element for a directional coupler.

FIG. 12 shows a representation of a matched termination 37 for a directional coupler 14. If the coupler 14 of the invention is dimensioned in such a manner that a uniform power distribution arises on two ports—one speaks then of a "3 dB coupler"—there results a power distribution within the bandwidth according to Table 1 and a decoupling according to Table 2. As already stated, decoupling is present when as little as possible power transmission occurs between the ports.

TABLE 1

| Power distribution in the case of symmetric dimensioning | | |
|---|---|---|
| signal input | signal output ½ output power | signal output ½ output power |
| port (22) | port (21) | port (19) |
| port (19) | port (20) | port (22) |
| port (20) | port (19) | port (21) |
| port (21) | port (20) | port (22) |

TABLE 2

| Decoupling | |
|---|---|
| signal input | no signal output |
| port (21) | port (19) |
| port (19) | port (21) |
| port (20) | port (22) |
| port (22) | port (20) |

Those ports, at which power division occurs in the case of in-coupling through a third port, are, in the case of respective in-feeding, in each case, decoupled from one another. The remaining fourth port is, in turn, decoupled from the port used for in-feeding the power to be divided.

Figure 13:
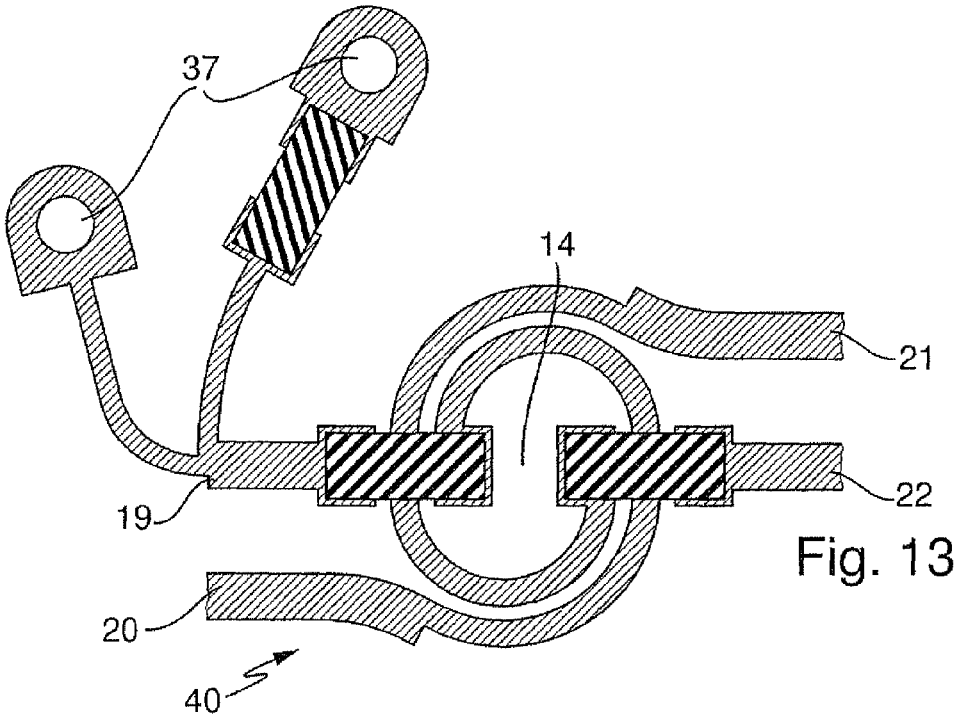
FIG. 13 is a representation of a preferred embodiment of the transmitting/receiving separator of the invention.

FIG. 13 shows a preferred embodiment of the transmitting/receiving separator of the invention 40 for e.g. a radar fill-level measuring device. With a matched termination 37, respectively terminating element, the coupler 14 of the invention becomes a transmitting/receiving separator 40. The matched termination 37 includes a connecting piece 39 between the matched termination 37 and the coupler 14. This connecting line portion 39 is a line portion of defined length, on whose end 38 the coupler 14 can be joined. Of course, also other forms of a matched termination 37 than the one shown here can be used. The connections remain the same. Other connections are evident from the characteristics of the coupler 14 according to the Tables 1 and 2. They are listed completely in Table 3. The different connections in the case of a radar fill-level measuring device are shown in FIGS. 13 to 16.

Figure 14:
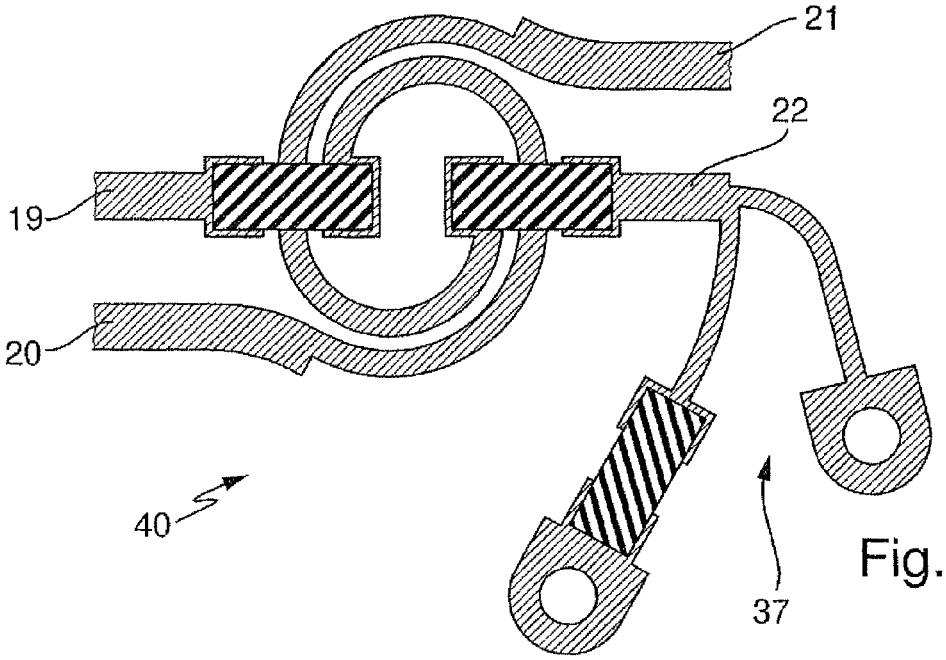
FIG. 14 is a representation of an embodiment of the transmitting/receiving separator of the invention, wherein the matched connection element is provided at a first port.
Figure 15:
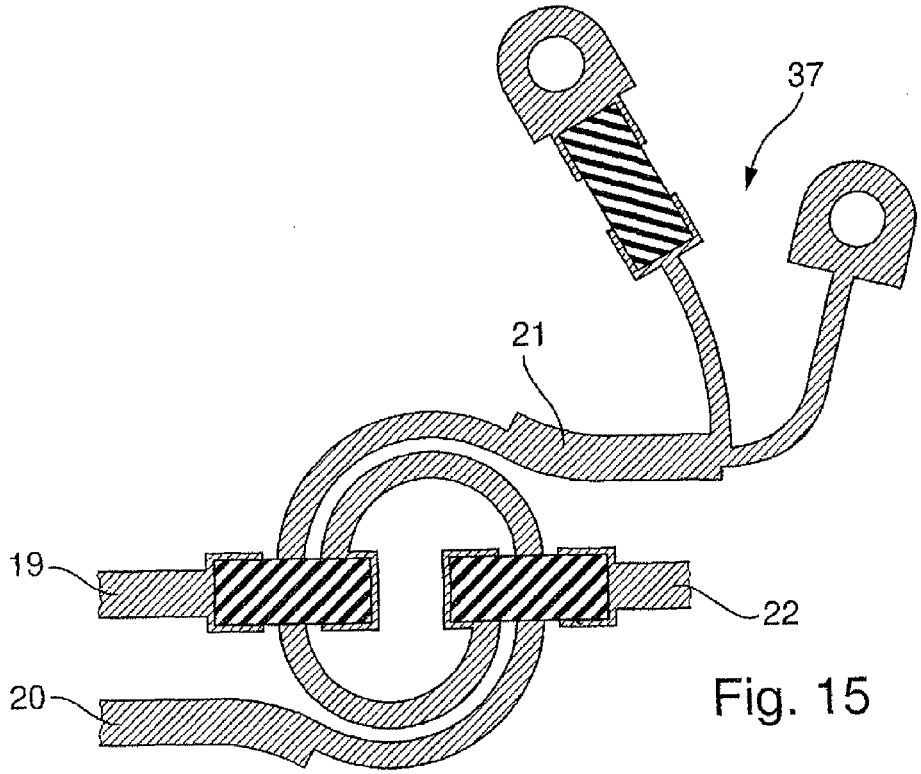
FIG. 15 is a representation of an embodiment of the transmitting/receiving separator of the invention, wherein the matched connection element is provided at a second port.
Figure 16:
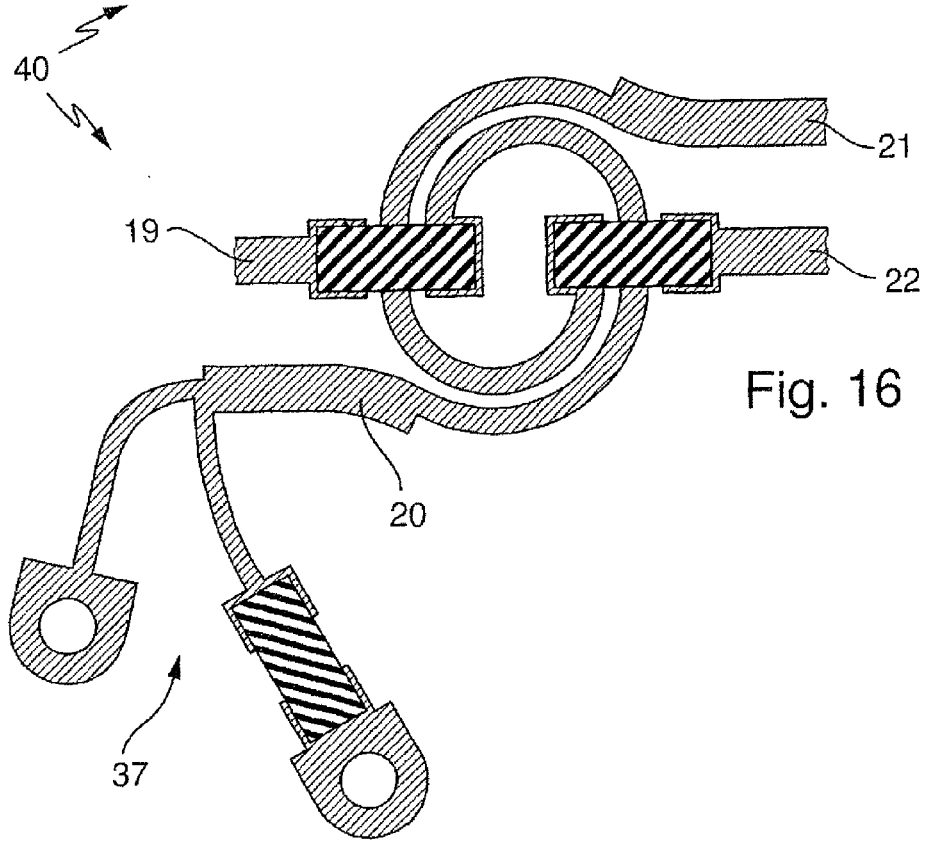
FIG. 16 is a representation of an embodiment of the transmitting/receiving separator of the invention, wherein the matched connection element is provided at a third port.

| connection per | port (20) | port (21) | port (22) | port (19) |
|---|---|---|---|---|
| FIG. 13 | transmitter | antenna | receiver | matched termination |
| FIG. 14 | antenna | transmitter | matched termination | receiver |
| FIG. 15 | transmitter | matched termination | receiver | antenna |
| FIG. 16 | matched termination | transmitter | antenna | receiver |
| FIG. 13 | receiver | antenna | transmitter | matched termination |
| FIG. 15 | receiver | matched termination | transmitter | antenna |
| FIG. 14 | antenna | receiver | matched termination | transmitter |
| FIG. 16 | termination matched | receiver | antenna | transmitter |

The invention claimed is:

1. A galvanically isolated, directional coupler for in- and out-coupling of high-frequency measurement signals of a radar fill-level measuring device, comprising:

two mutually engaging, oppositely bent, conductive traces, wherein the two oppositely bent, conductive traces are so arranged that conductive trace portions couple with one another over a region of a quarter wavelength (λ/4) of the wavelength associated with the center frequency of the measuring signals and form two groups of laterally coupled, conductive trace portions, wherein:

curved conductive trace portions adjoin each of said two groups of laterally coupled, conductive trace portions, in each case, over a region, which is less than an eighth of a wavelength (λ/8) of the wavelength associated with the center frequency, in a way such that said two groups of laterally coupled, conductive trace portions and curved conductive trace portions are configured in a way so that the coupler has a rounded shape, and wherein said directional coupler is constructed of at least one SMD component.

2. The galvanically isolated directional coupler as claimed in claim 1, wherein:

said SMD component is a capacitor.

3. The galvanically isolated directional coupler as claimed in claim 1, wherein:

said at least one SMD component comprises two equally constructed resistors.

4. The galvanically isolated directional coupler as claimed in claim 1, wherein:

the at least one component is arranged in a horizontal plane of a circuit board or wherein the at least one component is arranged in at least two parallel planes of a circuit board.

5. A galvanically isolated, directional coupler for in- and out-coupling of high-frequency measurement signals of a radar fill-level measuring device, comprising:

two mutually engaging, oppositely bent, conductive traces, wherein the two oppositely bent, conductive traces are so arranged that conductive trace portions couple with one another over a region of a quarter wavelength (λ/4) of the wavelength associated with the center frequency of the measuring signals and form two groups of laterally coupled, conductive trace portions, wherein:

curved conductive trace portions adjoin each of said two groups of laterally coupled, conductive trace portions, in each case, over a region, which is less than an eighth of a wavelength (λ/8) of the wavelength associated with the center frequency, in a way such that said two groups of laterally coupled, conductive trace portions and curved conductive trace portions are configured in a way so that the coupler has a rounded shape, and wherein:

two transitions between the bent, laterally coupled, conductive traces and the bent conductive traces are so embodied that the high-frequency measuring signals are transmitted with an as great as possible bandwidth.

6. A galvanically isolated, directional coupler for in- and out-coupling of high-frequency measurement signals of a radar fill-level measuring device, comprising:

two mutually engaging, oppositely bent, conductive traces, wherein the two oppositely bent, conductive traces are so arranged that conductive trace portions couple with one another over a region of a quarter wavelength (λ/4) of the wavelength associated with the center frequency of the measuring signals and form two groups of laterally coupled, conductive trace portions, wherein:

curved conductive trace portions adjoin each of said two groups of laterally coupled, conductive trace portions, in each case, over a region, which is less than an eighth of a wavelength (λ/8) of the wavelength associated with the center frequency, in a way such that said two groups of laterally coupled, conductive trace portions and curved conductive trace portions are configured in a way so that the coupler has a rounded shape, and, wherein:

said conductive traces have a toothed structure.

7. A galvanically isolated, directional coupler for in- and out-coupling of high-frequency measurement signals of a radar fill-level measuring device, comprising:

two mutually engaging, oppositely bent, conductive traces, wherein the two oppositely bent, conductive traces are so arranged that conductive trace portions couple with one another over a region of a quarter wavelength (λ/4) of the wavelength associated with the center frequency of the measuring signals and form two groups of laterally coupled, conductive trace portions, wherein:

curved conductive trace portions adjoin each of said two groups of laterally coupled, conductive trace portions, in each case, over a region, which is less than an eighth of a wavelength (λ/8) of the wavelength associated with the center frequency, in a way such that said two groups of laterally coupled, conductive trace portions and curved conductive trace portions are configured in a way so that the coupler has a rounded shape, and wherein:

said directional coupler is so dimensioned that it acts as a 3 dB coupler.

8. A transmitting/receiving separator for a radar fill-level measuring device, comprising:

a directional coupler as claimed in claim 1; and a terminating element, respectively a high frequency sink, which is provided at one of at least four ports of said directional coupler.

9. The transmitting/receiving separator as claimed in claim 8, wherein:

said terminating element, respectively the high frequency sink, comprises a resistor, which has double the resistance of the line wave resistance respectively impedance, and a match structure.

10. A transmitting/receiving separator for a radar fill-level measuring device, comprising:

a galvanically isolated, directional coupler comprising two mutually engaging, oppositely bent, conductive traces, wherein the two oppositely bent, conductive traces are so arranged that the conductive trace portions couple with one another over a region of a quarter wavelength (λ/4) of the wavelength associated with the center frequency of the measuring signals and form two groups of laterally coupled, conductive traces, wherein curved conductive trace portions adjoin each of said two groups of laterally coupled, conductive traces, in each case, over a region, which is less than an eighth of a wavelength (λ/8) of the wavelength associated with the center frequency; and a terminating element, respectively a high frequency sink, which is provided at one of at least four ports of said directional coupler, wherein said terminating element, respectively the high frequency sink, comprises a resistor, which has double the resistance of the line wave resistance respectively impedance, and a match structure, and wherein said match structure comprises three mutually connected, conductive trace portions of defined length and width and two vias to the reference potential ply of a circuit card.

11. The transmitting-receiving separator as claimed in claim 8, wherein:

the three remaining ports of said directional coupler are connected to an antenna, a transmitting unit and a receiving unit of the radar fill level measurement device.

* * * * *